US005758384A

United States Patent [19]

Kelly

[11] Patent Number: 5,758,384

[45] Date of Patent: Jun. 2, 1998

[54] DEVICE FOR BRUSHING DENTURES

[76] Inventor: James Kelly, 36 Newkirk Rd., Yonkers, N.Y. 10710

[21] Appl. No.: 795,141

[22] Filed: Feb. 7, 1997

[51] Int. Cl.[6] ..... A46B 9/04

[52] U.S. Cl. ..... 15/167.1; 15/160

[58] Field of Search ..... 15/167.1, 167.3, 15/143.1, 159.1, 160

[56] References Cited

U.S. PATENT DOCUMENTS

| | | | |
|---|---|---|---|
| D. 96,749 | 9/1935 | Hellonen | 15/167.1 |
| 1,048,740 | 12/1912 | Sarrazin | 15/167.1 |
| 2,190,277 | 2/1940 | Viragh | 15/167.1 |
| 2,236,034 | 3/1941 | Luce | 15/167.1 |
| 3,010,131 | 11/1961 | Kisky | 15/167.1 |
| 3,188,673 | 6/1965 | Newman | 15/167.1 |
| 3,864,781 | 2/1975 | Leonard . | |
| 3,934,298 | 1/1976 | Kim . | |
| 4,306,327 | 12/1981 | Zeski | 15/167.1 |
| 4,888,844 | 12/1989 | Maggs . | |
| 4,984,323 | 1/1991 | Digby . | |
| 5,014,383 | 5/1991 | Costar . | |
| 5,383,244 | 1/1995 | Ahrens et al. . | |
| 5,398,368 | 3/1995 | Elder . | |

FOREIGN PATENT DOCUMENTS

| | | | |
|---|---|---|---|
| 0108461 | 1/1925 | France | 15/167.1 |
| 0001044 | 3/1979 | Germany | 15/167.1 |
| 0117317 | 1/1927 | Switzerland | 15/167.1 |
| 2208470 | 4/1989 | United Kingdom | 15/167.1 |

*Primary Examiner*—Randall Chin
*Attorney, Agent, or Firm*—Brian L. Wamsley

[57] ABSTRACT

The invention relates to a denture brush having a flat handle which projects substantially perpendicularly from the plane of the brush head. Finger grips are located on each side of the handle. In addition, the plane of the handle is offset 90° from the plane of the bristles. This alignment allows the brush to be easily grasped while facilitating the brushing motion in alternate lateral directions in the plane of the bristles and parallel to the internal surface of the denture. The orientation of the finger grips with the bristles also facilitates the ease of applying brushing force directly downward through the brushing head to the denture surface.

8 Claims, 3 Drawing Sheets

DEVICE FOR BRUSHING DENTURES

The present invention is directed toward a new type of brush which is particulary useful for cleaning dentures. Specifically, applicant's invention relates to a denture brush having a flat handle that is offset substantially perpendicularly to the plane of the brush head. Finger grips are located on each side of the handle at 90° from the plane of the bristles. This alignment allows the brush to be grasped for ease of the brushing motion in a direction in the plane of the bristles and parallel to the internal surface of the denture. The orientation of the finger grips with the bristles also facilitates the ease of applying brushing force directly downward through the brushing head to the denture surface. Further, the length and width of the brush head is related to the radius and width of the interior portion of the denture to provide maximum contact of the bristles with the denture surface, and allow ease of insertion of the denture brush.

BACKGROUND OF THE INVENTION

Dentures are typically three dimensional molds that include a denture base and teeth. The denture base of an upper denture includes a palate area and a gum channel portion. The gum channel portion of an upper denture is formed by an upwardly extending flange that has high or low palate grooves. The denture base of a lower denture includes a "U" shaped gum channel formed by an inner lingual flange and an outer facial flange. Because of the complex shapes and contours of the various parts of the denture, conventional toothbrushes are not generally suited to adequately clean dentures, and particularly the gum channel portions, since the handles of these brushes are inadequately oriented with respect to the brush head to provide effective brushing force during the brushing motion. In addition, these brushes are generally too soft or too wide so that hardened matter is difficult to remove. Wide brushes as disclosed in U.S. Pat. No. 5,014,383, do not adequately fit into the small pallette grooves or the rugae in the "U" shaped gum channel.

Conventional denture cleaning brushes, such as those disclosed in U.S. Pat. Nos. 3,864,781 and 5,383,244, incorporate one or more planar surfaces of bristle tufts having varying widths and lengths, some angled axially about a central axis, or combinatons thereof. More importanly, conventional denture brushes have handles that are aligned axially in the same plane as the brush head, containing the bristles, as in the style of most toothbrushes. These handles are actually laterally elongated extensions of the brush head and are in the same plane as the brush head. The bristles therefore project perpendicularly from the brush head and the plane of the handle. Not only is it difficult to insert the brush head of this type of denture brush directly into the gum channels and apply the bristles to the denture surface to be cleaned, but it is also difficult to apply adequate manual force directly to the denture surface through the brush head. That is, in the conventional denture brush, brushing force applied by the handle is offset laterally and therefore indirectly applied to the brushing head. This diminishes the force that can be applied directly to the denture surface.

Also, because complete and effective denture cleaning still requires scrubbing and brushing, denture wearers had to rely on brushes of the toothbrush variety configuration or other style brushes. Denture wearers that have limited use of their hands and fingers because of injuries, an arthritic condition or some infirmity, have additional problems when using denture brushes where the grip is not in proper alignment and when the handle is offset from the plane of the bristles. The size and shape of toothbrush style handles are generally too small and too narrow to grasp comfortably when one has dimished use of hands or fingers. Plus, the handles can become slippery when wet or covered with cleaning paste or liquid. That style of handle requires a necessary degree of dexterity or strength by the user for manual operation.

SUMMARY OF THE INVENTION

Accordingly, it is an object of the present invention to provide an improved denture cleaning brush that is more easily gripped and held by denture wearers that have limited use of their hands or fingers. Denture wearers should be able to more easily apply downward brushing force to the denture surface, while simultaneously applying lateral force in the brushing direction.

It is a further object of the invention to provide a denture cleaning brush where brushing force can be more easily directed downward and directly through the brush head to the denture surface to be cleaned.

Another object of the invention is to provide a denture brush where the brush head is easily insertable into the gum channels of the upper and lower denture.

In accordance with the invention, a denture brush is provided having a handle that is offset substantially perpendicularly from the plane of the brush head, which allows brushing force to be directly applied through the brush head and bristles to the denture surface to be cleaned. The handle further has finger grips that allow for ease of grasping and applying brushing force laterally across the surface of the denture and in the direction of the plane of the bristles. In the preferred embodiment, the handle is flat with two sides. A finger grip surface may be located on one or both sides. Significantly, the plane of the flat handle is oriented 90° from the plane of the bristles. In this manner, brushing force may be easily applied lateraly in the direction of the plane of the bristles while still being maintained in a downward direction.

DETAILED DESCRIPTION OF THE INVENTION

Figure 1:
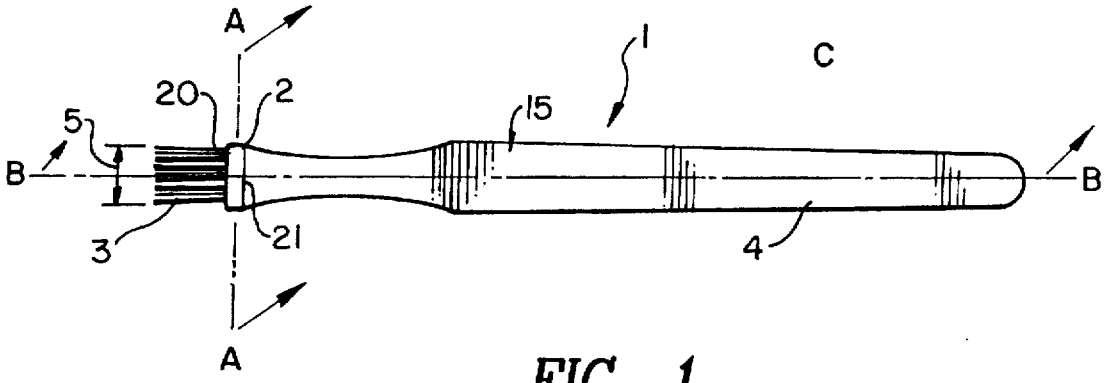
FIG. 1 is a side view of the denture brush in accordance with the present invention, along planes A and B, where plane A defines the plane of the brush head and plane B defines the plane of the bristles.

Referring to the side view of FIG. 1 depicting the denture brush 1 according to the present invention, a brush head 2 is shown in a side view with bristles 3 being projected from a side 20 of the brush head 2 is seen to be lying in plane A which is situated perpendicularly from plane C of FIG. 1, and also perpendicularly from plane B, which defines the plane of the bristles 3. Thus, a side view of the bristles is obtained, illustrating the width dimension 5 of the brush head 2. The bristles are arranged in rows as generally seen in toothbrushes. Although any number of rows of bristle tufts may be used, it is desirable to keep the width of the brush head narrow enough for insertion into the gum channel of a denture. Therefore, it is preferred to use about three rows of bristle tufts. Plane B is also perpendicular to planes A and C, which together, all three planes describe a three-dimensional view. In the context of the three dimensional x,y,z convention commonly used in mathematics, plane A corresponds to the y,z plane, plane B corresponds to the x,z plane and plane C corresponds to the x,y plane. A brush handle 4 extends perpendicularly from side 21 of the brush head 2 and plane A, but is directly situated in plane B of the bristles 3.

Figure 2:
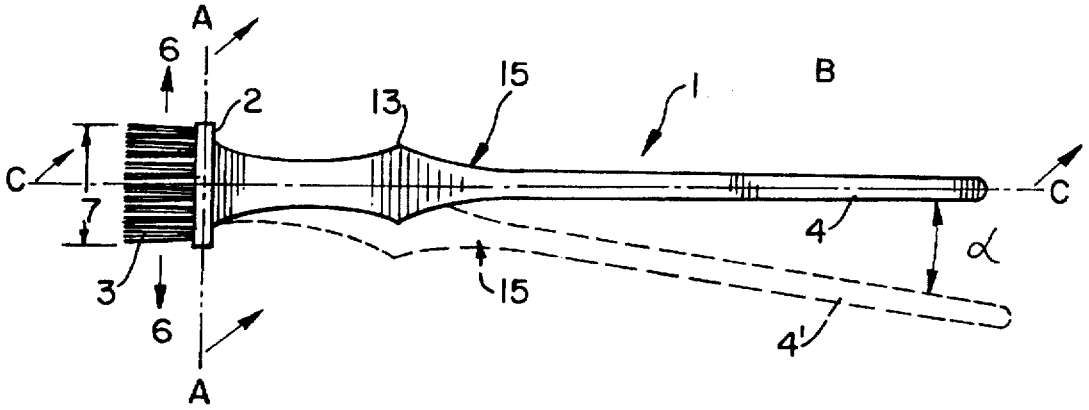
FIG. 2 is a further side view of the denture brush of FIG. 1 rotated 90° about the axis B, of FIG. 1 and plane C defines the plane of a flat handle.

FIG. 2 is a further side view of denture brush 1 after having been rotated 90° about the axis defined by plane B. Handle 4 is seen as being flat, as this is the preferred form, although it could be virtually any shape that lends itself to being easily grasped by the human hand, said handle being in this flat form being defined by plane C. On each side of handle 4 are flat surface areas configured as finger gripping surfaces 15. When viewed in the previous side view as shown in FIG. 1, the flat plane C of the handle, and necessarily therefor the flat gripping surfaces 15, is in alignment with the width dimension 5 of the brush head 2. That is, when viewed in the direction of FIG. 1, one sees the width, not the length, of the brush head and the flat surface of the brush handle. This orientation of the handle with respect to the brush head requires the user to grip the handle such that brushing force application is facilitated to move the brush in reciprocal directions along the length dimension of head within the gum channels. Although generally flat, the finger grip surfaces need not be smooth. Indeed, in the preferred embodiment the finger grip surfaces are textured to reduce slipperiness. The texturing could take to form of parallel lines etched into the surface, cross-hatching, or any similar design. In addition, the finger grip surfaces could be concavely curved trough-like surfaces and/or elongated along the length of the handle. Also, the handle may attained a gradual thickness in the area of the finger grip surface and, preferrably, also provide a nub 13 at the thickest point to also facilitate gripping. It is conceivable that only one finger grip surface 15 be located on one side of the handle 4, but two finger grips are preferred. The finger grip surfaces 15 of the handle 4 also lie in plane C and are therefore disposed 90° from plane B, the plane of the bristles. Significantly, the finger grip surfaces 15 allow force to be laterally directed in plane B in a reciprocal side-to-side fashion in alternate lateral directions 6.

Figure 6:
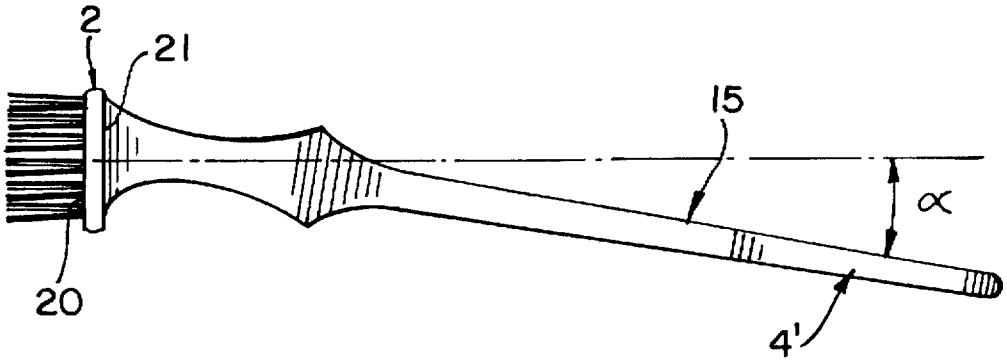
FIG. 6 is an additional side view of the denture brush of FIG. 2, showing the acute angle of the preferred embodiment.

Handle 4 projects from brush head 2 in a direction opposite the bristles, which can be perpendicular to the brush head. However, as also illustrated by FIG. 2, the handle 4' can also be slightly angled $\alpha$from the perpendicular, but remaining in plane B. The handle 4' extending from an acute angle $\alpha$from the side 21 of the brush head, 2 opposite the side 20 of the bristles, is more clearly shown in FIG. 6. Angling the handle 4' in this manner can, for some users, provide an even further advantage in gripping the brush, and permits a small amount of leverage to be applied to the brushing surface. In addition, angling the handle provides the user with a better view of the brushing surface during cleaning of the denture. For the purpose of this invention, it has been found that the angle $\alpha$ of the handle 4' could range from 0° to about 15°, with the ideal range being from about 5° to about 10°. Also shown in FIG. 2 is the length 7 of the brush head 2, which necessarily determines the number of lengthwise rows of bristle tufts 3. While the length 7 of the brush head 2 may be similar to the length of a conventional toothbrush, it is generally preferred that the length 7 is shorter than the average toothbrush in consideration of the radii of gum channels in the dentures. In the preferred embodiment, the width 5 of the brush head is defined by three rows of bristle tufts, and the length 7 of the brush head is shorter than a standard toothbrush. If the length is too long, the denture brush will not be easily inserted into the gum channel and lateral brushing action will be curtailed. Moreover, the brush head must be long enough so that an adequate number of bristles can be used.

Figure 3:
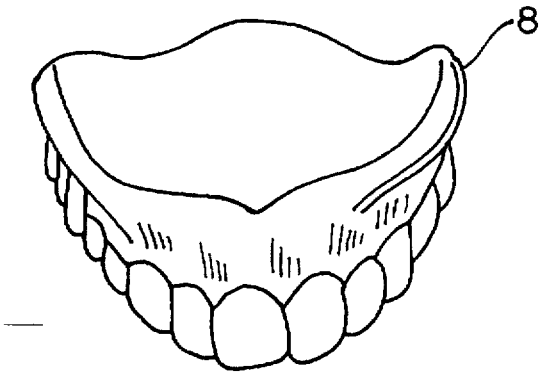
FIG. 3 is a perspective view of an upper denture.

FIG. 3 shows perspectively an upper denture 8. A cross-sectional view of the upper denture 8 is shown in FIG. 5 with the denture brush inserted into the gum channel 9. The handle 4 is shown with one of the finger grip surfaces 15 facing the viewer, in alignment with the brush head width dimension 5, and being in plane C, which is the plane of the Figure. FIG. 5 views the bristles from along the edge of the bristle plane B, which is clearly perpendicular, i.e., offset 90° from plane C, the plane of the handle. This orientation of the finger grip surfaces in relation to the bristles allows for a better grip on the brush while providing brushing force in alternate lateral directions 6 in plane B. This is more readily illustrated in FIG. 4, which shows the brush 1 with the head 2 inserted into the gum channel 10 of an inverted lower denture 11. The alternate lateral brushing motion in directions 6 is shown with respect to the plane 6 of the bristles 3.

Figure 4:
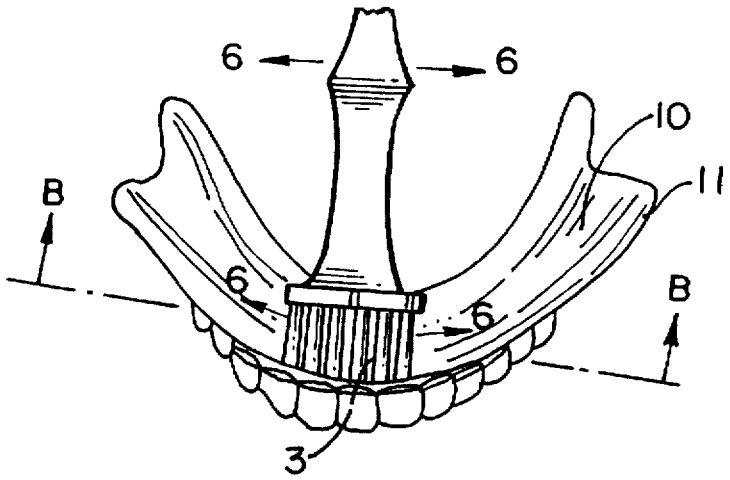
FIG. 4 is a perspective view of an inverted lower denture with the denture brush of this invention inserted.
Figure 5:
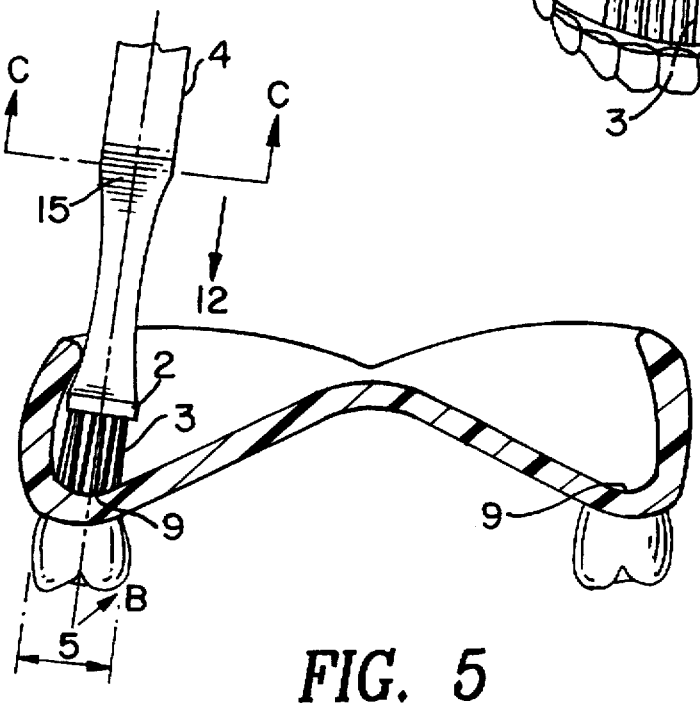
FIG. 5 is a cross-sectional view of an upper denture with the denture brush of this invention.

In conjunction with the ease of gripping the brush and while providing ease of applying brushing force in alternate lateral directions, the brush handle 4 projecting from the head 2 in a direction opposited the bristles, means that the handle is directly behind the bristles, as depicted in FIGS. 4 and 5. This positioning of the brush handle allows for ease of applying further force in direction 12, through the head 2 to the surface of the gum channel 9. Thus, the overall configuration of the handle and finger grip surfaces with relation to the head allows for force to be applied simultaneously in several directions, while maintaining a tight grip on the handle of the brush.

Because the fingers of some users might be mishapen, missing, stiff or larger than usual, alternative embodiments of the denture brush may be apparent to those of skill in the art.

While the present invention has been explained in relation to its preferred embodiment, it is to be understood that various modifications thereof will be apparent to those skilled in the art upon reading this specification. The invention disclosed herein is therefore intended to cover all such modifications that fall within the scope of the appended claims.

What is claimed is:

1. A denture brush for manually cleaning dentures, comprising:

a brush head configured to be insertable into the gum channels of dentures, said brush head being substantially flat and having an elongated shape with a length dimension and a width dimension, and a first side and a second side oppositely disposed from the first side, wherein said brush has only a single set of bristles, said set of bristles projecting perpendicularly from the first side of the brush head and disposed along the length dimension of the brush head, said bristles and said length dimension defining a plane of the bristles, an elongated and substantially flat, straight handle projecting directly from a center region of the second side of the brush head in a direction substantially opposite the bristles, said handle comprising first and second oppositely disposed flat parallel surfaces, wherein the handle is oriented such that the parallel surfaces are in alignment with the width dimension of the brush head, thereby facilitating the ease of grasping by the user and the application of brushing force in reciprocal directions along the plane of the bristles, and wherein the handle is joined to the brush head at an acute angle.

2. The brush according to claim 1 wherein at least one of the oppositely disposed surfaces of the handle is configured as a finger grip surface.

3. The brush according to claim 2, wherein said finger grip surface is configured as a textured surface.

4. The brush according to claim 2, wherein said finger grip surface is configured as a concave surface.

5. The brush according to claim 1, wherein the acute angle is between about 5° to about 15°.

6. The brush according to claim 5, wherein the acute angle is about 10°.

7. The brush according to claim 1, wherein a lengthwise axis of the handle is co-planar with the plane of the bristles.

8. The brush according to claim 1 wherein the brush head comprises three rows of bristle tufts and the length dimension of the brush head is shorter than a length of a standard toothbrush.

* * * * *